US006373363B1

(12) United States Patent
Spakowski et al.

(10) Patent No.: US 6,373,363 B1
(45) Date of Patent: Apr. 16, 2002

(54) DUAL COIL SOLENOID FOR A GAS DIRECT INJECTION FUEL INJECTOR

(75) Inventors: Joseph George Spakowski, Rochester; Gail E. Geiger, Caledonia; John Henry Delaney, Scottsville, all of NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/535,833

(22) Filed: Mar. 28, 2000

(51) Int. Cl.[7] ..... H01F 3/00

(52) U.S. Cl. ..... 335/256; 335/251; 335/268; 251/129.15

(58) Field of Search ..... 335/251, 255, 335/256, 258, 260, 266, 268; 123/90.11; 251/129.01–129.15

(56) References Cited

U.S. PATENT DOCUMENTS 4,253,493 A * 3/1981 English ..... 335/266
5,363,270 A * 11/1994 Wahba ..... 335/177

* cited by examiner

*Primary Examiner*—Lincoln Donovan
(74) *Attorney, Agent, or Firm*—John VanOphem

(57) ABSTRACT

An actuator (10) for a fuel injector having a dual coil solenoid. The solenoid coils (14, 16) are connected in parallel and have windings that are wound in opposite directions. The actuator (10) of the present invention defines three air gap surfaces (22, 24, 26), one of which (24) is located in the space shared between the two coils (14, 16). The shared air gap surface (24) has a high flux density due to the additive nature of the magnetic forces between the oppositely wound coils (4, 16). The dual-coil solenoid of the actuator (10) of the present invention creates a very high force and a low inductive load which results in fast injector response times.

12 Claims, 2 Drawing Sheets

DUAL COIL SOLENOID FOR A GAS DIRECT INJECTION FUEL INJECTOR

TECHNICAL FIELD

The present invention relates to a solenoid control valve for a gas direct injection fuel injector and more particularly to a dual coil, high force solenoid control valve for a gas direct injection fuel injector.

BACKGROUND OF THE INVENTION

Solenoid-actuated valve assemblies are widely used in a variety of applications including fuel injection systems. Typically the solenoid valve assembly has a housing within which is disposed a solenoid and a valve in axial alignment with one another. The solenoid typically includes a coil, a stator, a movable armature and a valve. Upon energization and de-energization of the coil, the armature moves to open and close the valve. It is desirable to have the injector as small as possible in order to fit within the limited space surrounding each cylinder of an engine. For example, direct injection fuel injectors typically have an outside diameter of 22 mm or larger.

Single coil solenoids are typical in fuel injection systems. However, they are often bulky and require high current and voltages in order to achieve the high force required to control the fuel flow requirements for the direct injection engine.

Dual coil solenoid devices also are typical in fuel injection engine systems. Typically, the coils are energized independently. For example, a first coil is energized to open the valve and a second coil is energized to close the valve. In other assemblies, the coils are energized simultaneously, but also independently, for a limited period of time. A first coil, having a high current, is used as a pull coil. The second coil, having a low current is used as a hold coil. In this example, a timing circuit is necessary in order to switch off the pull coil after the predetermined period of time has lapsed.

The problem with most dual-coil solenoid assemblies is that two separate drivers are needed to energize the coils. This adds size, weight, and obviously, cost to the solenoid assembly. In assemblies where the coils are energized simultaneously, high current drivers are required in order to achieve the necessary forces. Also, much larger diameter injectors, with high voltage, are required. These features also add unnecessary cost and complexity to the solenoid assembly.

Another concern is the fact that most engines have a wire harness plug to join the engine's circuitry to the solenoid assembly. The typical OEM wire harness plug provides a fixed electrical configuration, usually two or three electrical contacts, for supply to the solenoid. In some circumstances, dual-coil solenoid arrangements are not compatible with the standard OEM wire harness plug, which makes retrofitting solenoid assemblies costly and otherwise impractical.

SUMMARY OF THE INVENTION

The present invention is a dual coil, high force, solenoid valve for a gas direct injection fuel injector. The solenoid has two low inductance coils connected in parallel and simultaneously energized. The coils are wound in opposite directions such that the magnetic field created between the coils in a shared air gap is additive and creates a high flux density air gap, thereby creating a high force. Because the coils are connected in parallel, they create a very low inductive load to the injector driver. Lower inductive loads for the injector driver create faster current rise and fall times, which in conjunction with the high force, create very fast injector response times.

The invention is directed to the actuator, or solenoid, portion of an injector. A body houses two low impedance, low inductance coils connected in parallel, and wound in opposite directions. An armature, having three air gap surfaces with the body and a plug, is movable within the body. One of the air gap surfaces is mutually shared between the two coils and because of the opposing directions of the coil windings, the magnetic force is additive between the coils. Thus, the force generated in the mutually shared air gap has a high flux density and therefore produces a high force.

It is an object of the present invention to improve the response of a direct injection fuel injector. It is another object of the present invention to provide a high force for a direct injection fuel injector. It is still another object of the present invention to produce high magnetic forces with less current than conventional fuel injector solenoids.

It is a further object of the present invention to produce high magnetic forces within a packaging space that is smaller than conventional solenoids. Still a further object of the present invention is to provide a dual coil, high force solenoid having two coils connected in parallel and wound in opposite directions such that an additive magnetic force is created in an air gap surface that is mutually shared between the two coils.

Other objects and features of the present invention will become apparent when viewed in light of the detailed description of the preferred embodiment when taken in conjunction with the attached drawings and appended claims.

BRIEF DESCRIPTION OF THE DRAWINGS

In order that the present invention may be well understood, there will now be described some embodiments thereof, given by way of example, with reference to the accompanying drawings, in which.

DESCRIPTION OF THE PREFERRED EMBODIMENT

Figure 1:
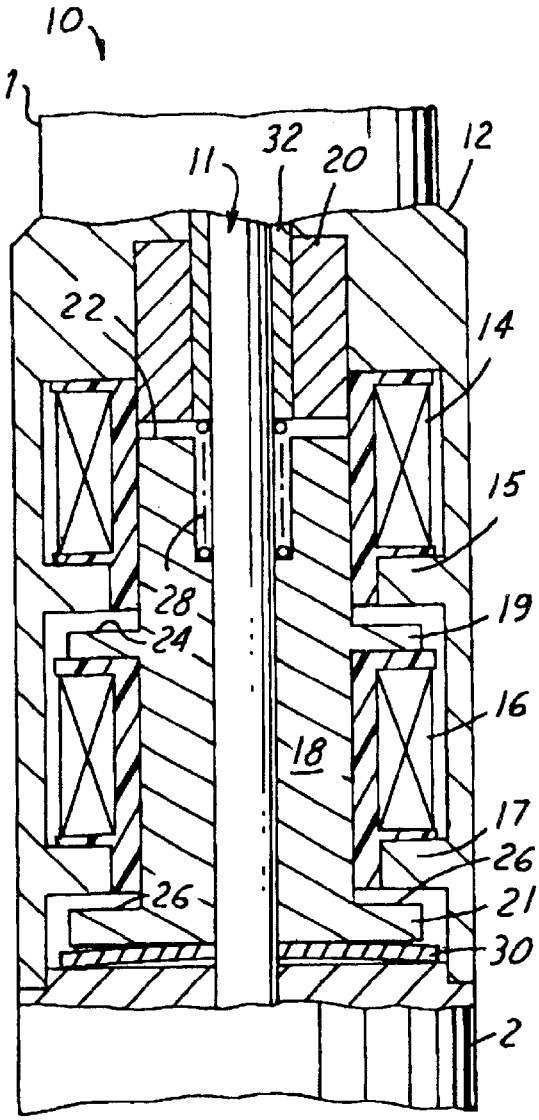
FIG. 1 is a cross sectional view of the dual-coil solenoid actuator of the present invention in a first position.
Figure 3:
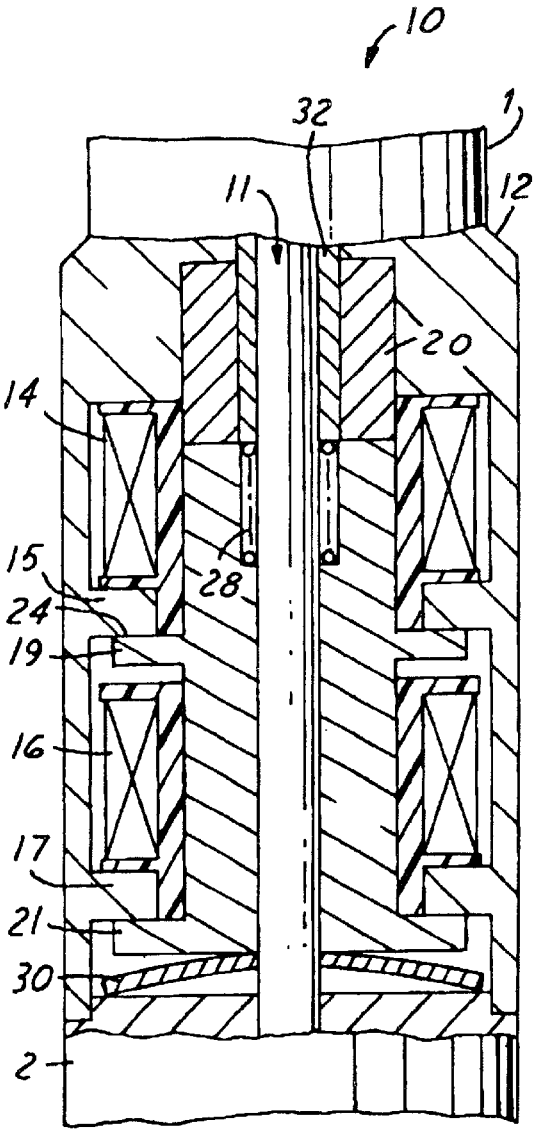
FIG. 3 is a cross sectional view of the dual-coil solenoid actuator of the present invention in a second position.

Referring to FIGS. 1 and 3, FIG. 1 is a diagram of the actuator portion of a fuel injector in a first position and FIG. 3 is a diagram of the actuator in a second position. The actuator portion of the fuel injector is shown between an upper injector assembly 1 and a lower injector assembly 2. The actuator assembly 10 of the present invention has a body portion 12 having a passageway 11 therethrough for fuel. Within the body portion 12, first and second coils 14 and 16 respectively are positioned and extensions 15 and 17 protrude from the body portion 12, below the coils 14 and 16, to separate the coils 14 and 16 and the armature 18. The coils 14 and 16 are low inductance, low impedance coils connected in parallel. Furthermore, the coils 14 and 16 are wound in opposite directions.

A movable armature 18 in relation to the extensions 15 and 17 on the body portion 12 and a plug 20 to create magnetic air gap surfaces 22, 24 and 26. The armature 18 is axially located within the body portion 12 and has a passageway 11 therethrough. Extensions 19 and 21 protrude from the armature 18 and are located below the extensions 15 and 17 on the body portion to form magnetic air gap surfaces 24 and 26. The air gap 22 is formed between the plug 20 and the armature 18. The solenoid coils 14 and 16 exert an axial force on the armature 18 when the coils are energized and de-energized, moving the armature 18 and thereby closing and opening the air gap surfaces 22, 24 and 26.

The plug 20 is press fit inside the body portion 12. The plug 20 is fixed and remains in place when the armature 18 moves. FIG. 1 shows the actuator in the open position. In this position the solenoid is energized and the armature 18 moves upward so that it abuts the plug 20, closing the air gap surfaces 22, 24 and 26. When the solenoid coils 14 and 16 are de-energized, the actuator is in a closed position (not shown). The armature 18 is moved to a lower position and air gap surfaces 22, 24 and 26 are open.

Two springs, a low rate spring 28 and a high rate spring 30 move the armature 18 when the solenoid is de-energized and bias the position of the armature 18. Spring adjusting member 32 is located within the passageway 11 of the body portion 12. The low rate spring 28 is positioned on the inside diameter of the armature 18 below the spring adjusting member 32. The high rate spring 30 is in the shape of a flat disk and is typically made of a corrosion resistant material. The high rate spring 30 is retained within the body portion 12 below the armature 18. The high rate spring 30 has a passage 11 through its center. It should be noted that while low rate and high rate springs are shown in the present example, it is possible to substitute other methods of biasing the movement of the armature 18. For example, it is possible to use either the low rate spring or the high rate spring, as opposed to both springs, and achieve similar results. One skilled in the art will recognize that low rate and high rate refer to the tension in the spring.

Magnetic air gaps 22 and 26 have magnetic forces generated by coils 14 and 16 respectively. According to the present invention, magnetic air gap 24 is unique because it is shared between coils 14 and 16. Because air gap 24 is mutually shared between the coils 14 and 16, a higher force is created due to the higher flux density in the air gap 24. For this reason, it is important that the coils 14 and 16 are wound in opposing directions. With the proper winding configurations, the flux in air gap 24 is additive and therefore, does not cancel.

Figure 2:
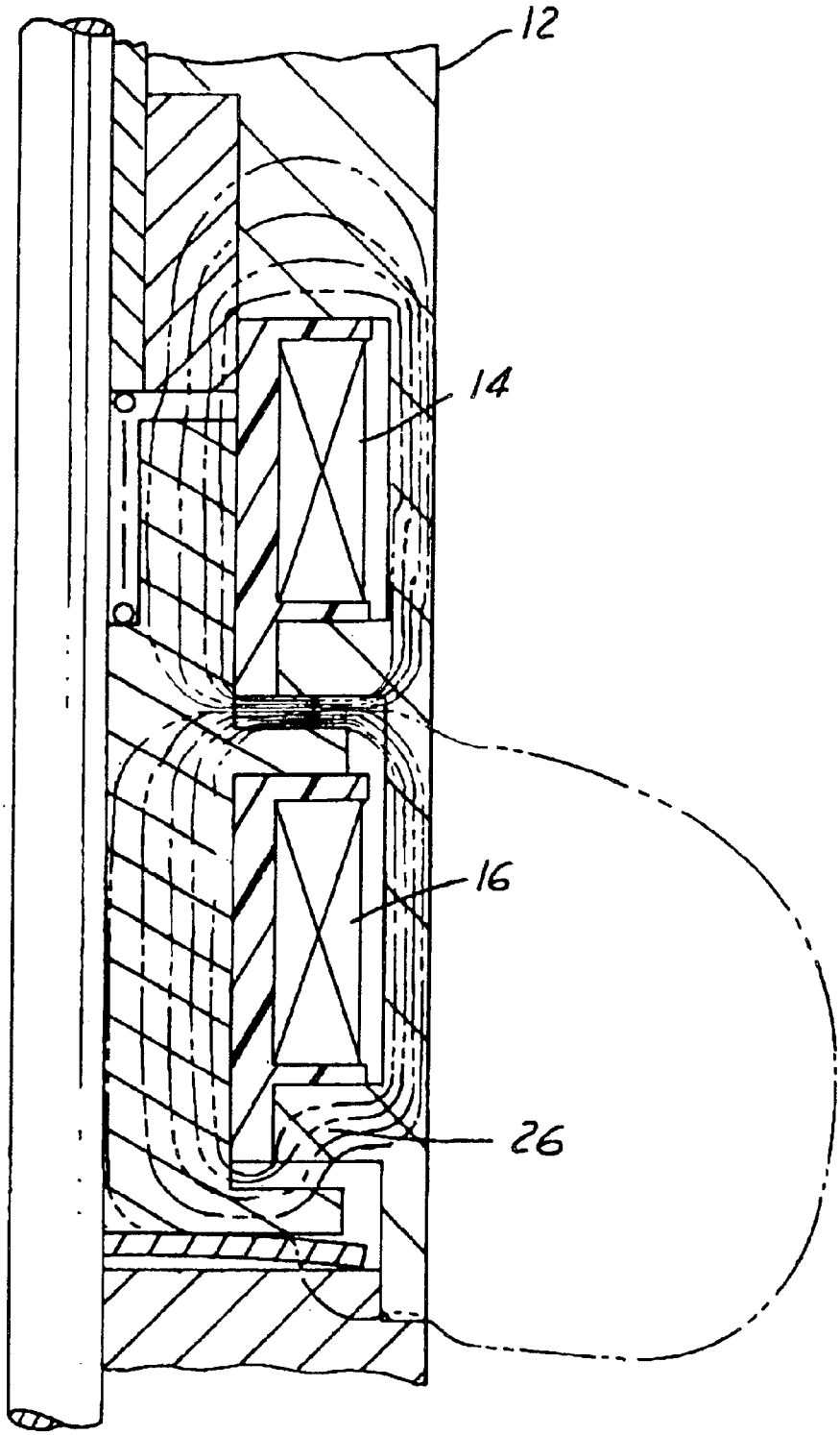
FIG. 2 is a diagram of the magnetic fields associated with the dual-coil solenoid actuator of the present invention.

FIG. 2 is a diagram of Maxwell® magnetic modeling results for the actuator of the present invention. In the example modeled in FIG. 2, the coils have 40 turns each, but in opposing directions. It is shown that the flux density in air gap 24 is much higher than the density in air gaps 22 and 26. The actuator 10 has low inductance, low resistance and the coils can have a smaller number of turns while still achieving the necessary forces. The actuator of the present invention has significant advantages over prior art designs, whether single or dual coil designs. Greater force is produced when both coils are energized simultaneously and the resistive and inductive loads on the drive circuit are less than a single coil of equivalent value.

For example, in the case of a single coil design the equation F=N*I represents the force. A higher force is accomplished by either increasing the number of turns, N, of the coil or increasing the current, I. When the number of turns, N, is increased the inductance increases and the current response time, $I_{Rt}$, increases. The current response time can be modified by increasing the voltage of the system.

There are significant drawbacks with this system. The increase in the number of turns increases the size of the coil, the current increase increases the voltage of the system, and the driver becomes more costly. Therefore, the entire system becomes larger, heavier and more costly. For the dual coil design in which the coils are driven independently, the added size weight and cost is attributable to the need for two drivers, two wiring harness connectors, and it introduces mutual inductance problems.

In the actuator of the present invention, the two low impedance coils are connected in parallel and wound in opposite directions. Therefore, when both coils are energized simultaneously, greater force is produced. The mutual inductance of the coils is additive and does not cancel as is the case in prior art dual coil designs. Therefore, in the present invention, high magnetic forces are achieved with less current, smaller packaging space, and low voltage operation. Having the coils connected in parallel results in lower resistive and inductive loads on the drive circuit even in comparison to single coil designs.

With the actuator of the present invention, in which the coils are simultaneously driven in parallel, there is no mutual inductance, a high force is generated, the driver load has low inductance and low resistance, and the voltage and current remain low. The actuator of the present invention provides a high performance injector by increasing the force and response time and at a lower cost than prior art actuators.

An OEM wire harness plug (not shown) provides a fixed electrical configuration for supply to the fuel injector. Standard original equipment manufacturer's (OEM) wire harness connectors are compatible with the actuator of the present invention. Because the coils are connected in parallel, a two-pin connector is all that is required for the wire harness that connects to the injector.

While a particular embodiment of the invention has been shown and described, numerous variations and alternate embodiments will occur to those skilled in the art. Accordingly, it is intended that the invention be limited only in terms of the appended claims.

What is claimed is:

1. An actuator for a gas direct injection fuel injector, said actuator comprising:

a body member having an axial passageway therethrough;

a solenoid having a first coil disposed within said body member and surrounding said passageway, said first coil having windings disposed in a first direction, said solenoid having second coil connected in parallel with said first coil and having windings in a second direction opposite said first direction of said windings of said first coil, said second coil disposed within said body member and surrounding said passageway;

an armature disposed within said passageway of said body member and having a passageway therethrough, said armature being axially movable within said passageway, wherein said armature defines a first air gap above said armature, said armature defines a second air gap with said body member between said first and second coils, and said armature defines a third air gap with said body member below said second coil; and wherein a magnetic field within said second air gap has a flux density that is additive of magnetic fields for said first and second coils.

2. The actuator as claimed 1 further comprising a plug member press fit within said body member above said armature and intermediate with said first coil and wherein said first air gap is defined between said armature and said plug member.

3. The actuator as claimed in claim 2 further comprising a spring member in contact with said armature for biasing said armature in a first position.

4. The actuator as claimed in claim 3 wherein said spring member is a spring having a high tension rate and is located on a bottom surface of said armature, said spring being in the form of a disc and having a passageway therethrough coinciding with said passageway of said armature.

5. The actuator as claimed in claim 3 wherein said spring member is a spring having a low tension rate axially disposed within said passageway of said armature.

6. The actuator as claimed in claim 3 wherein said spring member further comprises:

a first spring having a low tension rate axially disposed within said passageway of said armature; and a second spring having a high tension rate located on a bottom surface of said armature, said second spring in the form of a disc and having a passageway therethrough coinciding with said passageway of said armature.

7. An electromagnetic fuel injector comprising:

an upper injector assembly having an axial fuel passage therethrough:

a middle body section connected to said upper injector assembly and having an axial fuel passage therethrough;

a solenoid having a first coil disposed within said middle body section and surrounding said passageway, said first coil having windings disposed in a first direction, said solenoid having a second coil connected in parallel with and spaced a distance below said first coil, said second coil having windings in a second direction opposite said first direction of said windings of said first coil, said second coil disposed within said middle body section and surrounding said passageway;

an armature disposed within said passageway of said middle body section and having a passageway therethrough, said armature being axially movable within said passageway wherein said armature defines a first air gap with said middle body section above armature, said armature defines a second air gap with said middle body section between said first and second coils, and said armature defines a third air gap surface with said middle body section below said second coil; and a lower injector assembly connected to said middle body section and having an axial fuel passageway therethrough.

8. The electromagnetic fuel injector as claimed in claim 7 further comprising a plug member press fit within said middle body section above said armature and intermediate with said first coil and wherein said first air gap is defined between said armature and said plug member.

9. The electromagnetic fuel injector as claimed in claim 7 further comprising a spring member in contact with said armature for biasing said armature in a first position.

10. The electromagnetic fuel injector as claimed in claim 9 wherein said spring member is a spring having a high tension rate and is located on a bottom surface of said armature, said spring being in the form of a disc and having a passageway therethrough coinciding with said passageway of said armature.

11. The electromagnetic fuel injector as claimed in claim 9 wherein said spring member is a spring having a low tension rate axially disposed within said passageway of said armature.

12. The electromagnetic fuel injector as claimed in claim 9 wherein said spring member further comprises:

a first spring having a low tension rate axially disposed within said passageway of said armature; and a second spring having a high tension rate located on a bottom surface of said armature, said second spring in the shape of a disc and having a passageway therethrough coinciding with said passageway of said armature.

* * * * *